US008157140B2

(12) United States Patent
Jay

(10) Patent No.: US 8,157,140 B2
(45) Date of Patent: Apr. 17, 2012

(54) WEARABLE ZIP WALLET

(76) Inventor: Paul Maxwell Jay, New York, NY (US)

( * ) Notice: Subject to any disclaimer, the term of this patent is extended or adjusted under 35 U.S.C. 154(b) by 1235 days.

(21) Appl. No.: 11/615,253

(22) Filed: Dec. 22, 2006

(65) Prior Publication Data

US 2008/0149235 A1 Jun. 26, 2008

(51) Int. Cl.
*A45C 1/06* (2006.01)

(52) U.S. Cl. ..... 224/666; 224/677; 224/269

(58) Field of Classification Search ..... 224/269, 224/677, 665, 666, 235, 601; 24/3.12, 3.13, 24/429; 150/143; D3/218; 190/118
See application file for complete search history.

(56) References Cited

U.S. PATENT DOCUMENTS

| | | | | |
|---|---|---|---|---|
| 2,437,099 | A * | 3/1948 | Krupp | 150/107 |
| 2,802,501 | A * | 8/1957 | Stember | 150/101 |
| 3,937,373 | A * | 2/1976 | Artz | 224/666 |
| 4,416,315 | A * | 11/1983 | Foley | 150/134 |
| 4,446,997 | A * | 5/1984 | Himberg | 224/578 |
| 4,997,222 | A * | 3/1991 | Reed | 294/3.6 |
| 5,215,237 | A * | 6/1993 | Wu | 224/230 |
| 5,228,609 | A | 7/1993 | Gregory | |
| 5,285,833 | A * | 2/1994 | Haxby | 150/102 |
| 5,815,845 | A | 10/1998 | Ault et al. | |
| D433,801 | S * | 11/2000 | Shreve | D3/226 |
| 6,148,993 | A | 11/2000 | Chisolm et al. | |
| 6,435,392 | B1 * | 8/2002 | Kennedy | 224/680 |
| D481,866 | S * | 11/2003 | Lawrence, Sr. | D3/249 |
| 6,695,022 | B2 * | 2/2004 | Morehead | 150/134 |
| 6,698,636 | B2 | 3/2004 | Angus et al. | |
| 6,776,318 | B2 | 8/2004 | Washington | |
| 7,055,564 | B2 | 6/2006 | Carey et al. | |
| 7,073,462 | B1 | 7/2006 | Layman | |
| 7,111,714 | B1 * | 9/2006 | Bell, III | 190/118 |
| 7,124,921 | B1 | 10/2006 | Hubbell | |
| 2001/0027834 | A1 * | 10/2001 | Southwick | 150/108 |
| 2005/0017040 | A1 * | 1/2005 | Roberts et al. | 224/617 |

FOREIGN PATENT DOCUMENTS

EP 1139004 A2 * 10/2001

* cited by examiner

*Primary Examiner* — Justin Larson
(74) *Attorney, Agent, or Firm* — Locke Lord LLP

(57) ABSTRACT

A wallet having at least two surfaces defining an internal compartment, a zipper movably connecting one of the at least two surfaces to another of the at least two surfaces, the zipper being movable between a first position and a second position such that, when the zipper is in the first position, the wallet will be closed and will hang, and when the zipper is in the second position, the wallet will be open and the zipper will be in a position rotated by an angular amount from its hanging position such that the zipper will be in a substantially horizontal position.

15 Claims, 9 Drawing Sheets

WEARABLE ZIP WALLET

FIELD OF THE INVENTION

The present invention relates generally to a personal wearable zip wallet apparatus used for organizing commonly carried items such as a cell phone, electronics, keys and any other personal items needed and, more particularly, to such a zip wallet that can be adapted for use by an individual wherein the zip wallet's contents may be accessed with one hand.

BACKGROUND

Various personal carrying units have been utilized throughout history. With each technological advance, individuals are choosing to carry more personal effects on their person as they view them as necessities. Individuals have always sought ways to hold the various items that are now required in one's daily life (i.e., keys, cash, cell phone, credit cards, driver's license, employee identification card as well as any other personal effects) that they wish to have easy access to as the need arises (hereinafter, "necessary items").

All of the present manners and methods of carrying these necessary items lacks a practical way of carrying them all in one case so that they are easily accessed and not separated. Current options include placing the different items in different pockets of one's clothing. For those using a wallet, it is often placed in their back pocket containing legal tender as well as cards while their cell phone and their keys are placed somewhere else on their person. Those choosing to carry a handbag may, depending on its size, hold much of what is needed, including a purse.

Other attempts at a solution include: a pair of cargo pants with multiple pockets, a fanny pack, a belt clip for a cell phone, a chain-wallet and a shoulder bag, all of which have clear disadvantages. Cargo pants separate the necessary items into different locations, leading to a hunt through pockets when a key or other carried item is desired. Cargo pants may also be impractical in all social settings and climate environments. The fanny pack may hold many of the necessary items, but looks bulky and unfashionable, and further needs two hands to access the contents. Belt clips for cell phones are ill-designed to carry items other than a cell phone. Additionally, a chain-wallet must first be removed from a pocket before its contents may be accessed. A chain-wallet may also only carry those items which fit within the billfold when closed which ultimately must fit in the user's pocket.

Shoulder bags may also contain many of the necessary items, but they essentially function the same as a woman's handbag. One major disadvantage of shoulder bags is that the shoulder bag is easily separated from the person, e.g., someone may accidentally leave it behind. Another problem with shoulder bags and hand bags is that they require two hands to access the necessary items contained therein. Further, any items placed in their interior are not organized and they may move freely and may ultimately find themselves at the bottom of the bag being scratched by the other items therein. As such the bag, as a carrier, necessitates the use of a sub-carrier, such as a compartmentalized purse, otherwise none of the necessary and unnecessary items would remain separated such as keys, cell phones and personal care products. The ensuing contact between the items may lead to both aesthetic and structural damage to the bag and the items therein.

Further, Scotsmen used to carry such necessary items in a sporran which hung in the front of a kilt. In the age of cell phones, pagers, hand-held computers and i-Pods™, the design of a carrier must be updated, since society's necessary items have also changed.

Prior to this invention, the only way to transport all necessary items in one carrier was with a hand bag, a shoulder bag or a fanny pack. All of these have disadvantages, as does the folding wallet or chain-wallet that usually is slipped into the back pocket of a man's trousers. The folding wallet only carries flat necessary items, such as credit cards and legal tender without carrying capabilities for relatively bulky necessary items, i.e., keys on a key-ring and a cell phone or the like. Sitting on a wallet may also cause sciatica, and carrying a heavy bag may also cause physical injury. Also the repetitive placement of a rigid item in a pocket may either stretch or cause expedited wear to that article of clothing. Placing keys, or the like, with jagged sharp ends may also cause unnatural wear on a garment.

OBJECTS AND ADVANTAGES

Several objects and advantages of the present invention include, for example: all necessary items are easily accessible with one hand and necessary items are in one organized area, thereby preventing them from being scattered in the course of a day. By maintaining all of the necessary items together, this further eliminates time wasted in the search of an item. Further, the individual's clothing pockets are empty which enables the placement of unnecessary items in them, such as receipts, and the like. Further, individuals with disabilities who may have limited mobility due to crutches, a wheelchair or the like may easily access the contents of the present invention using only one hand.

These and other deficiencies were solved by providing a wearable personal carrier for necessary items.

SUMMARY

Various embodiments are provided herein which address among other things a wallet having at least two surfaces defining an internal compartment, a zipper movably connecting one of the at least two surfaces to another of the at least two surfaces, the zipper being movable between a first position and a second position such that, when the zipper is in the first position, the wallet will be closed and will hang from the first and second articles, and when the zipper is in the second position, the wallet will be open and the zipper will be in a position rotated by an angular amount from its hanging position such that the zipper will be in a substantially horizontal position, and so forth.

In accordance with an embodiment, opening a wearable zip wallet with one hand by gripping a corner above a rigidly affixed zipper, pulling the corner in a longitudinal direction moving the zipper from a closed position to an open position, and rotating the wallet an angular amount such that the wallet will hang in a substantially horizontal position.

BRIEF DESCRIPTION OF THE DRAWINGS

In the drawings, like reference numbers generally indicate identical, functionally similar, and/or structurally similar elements. The various exemplary embodiments will be described with reference to the accompanying drawings, wherein.

DETAILED DESCRIPTION OF THE VARIOUS EMBODIMENTS

Figure 9:
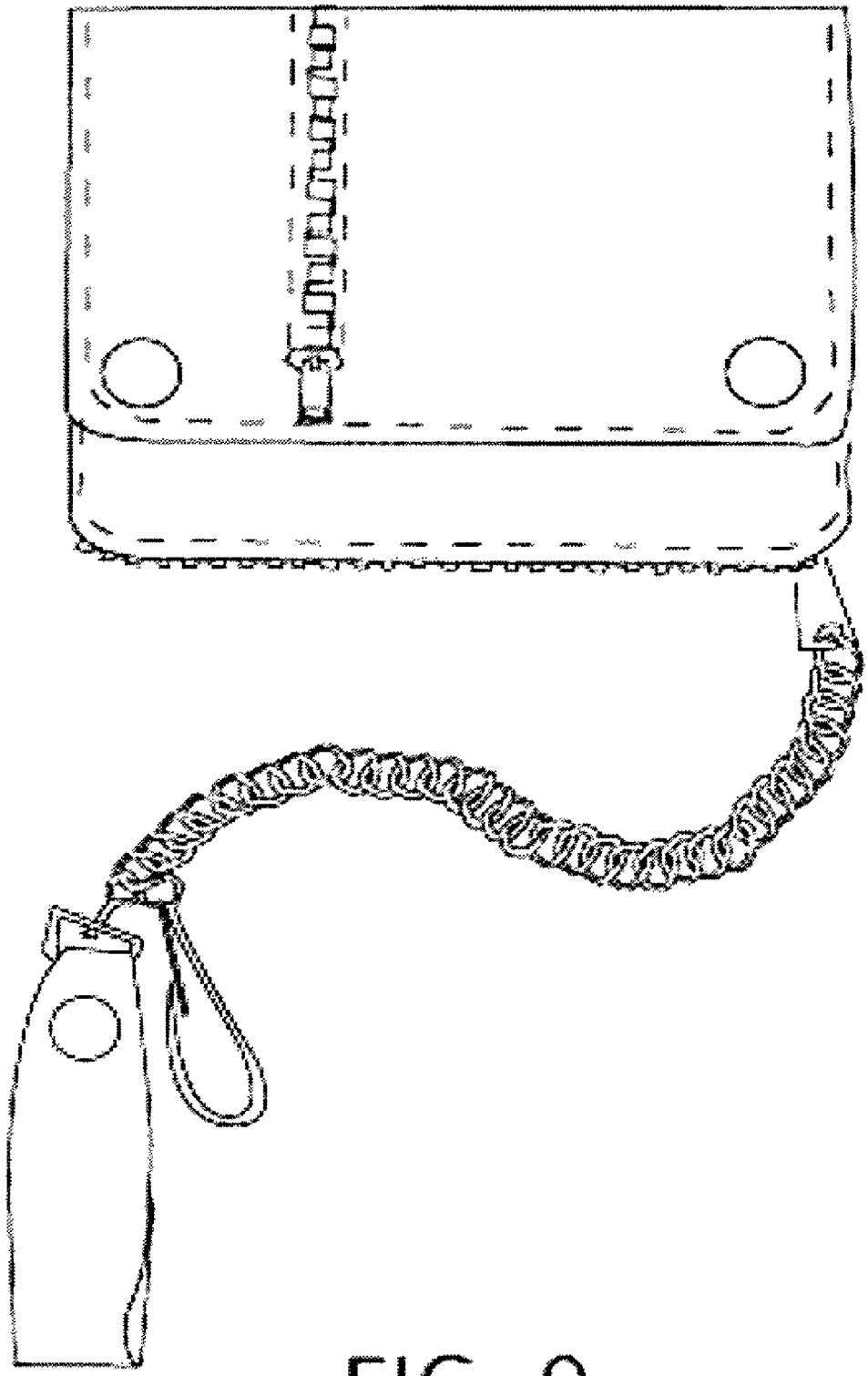
FIG. 9 is a perspective frontal view of a chain-wallet.

FIG. 9 is a perspective frontal view of a chain-wallet which is typically fastened to a belt, belt loop or the like via the clip wherein the attached wallet is placed in the wearer's pocket. Further, a user of a chain-wallet must remove the wallet from his pocket to access its contents. Some chain-wallets also have zippers, but the contents to be placed therein remain limited to those items which enable the entire wallet to be placed within the user's pocket.

Figure 1:
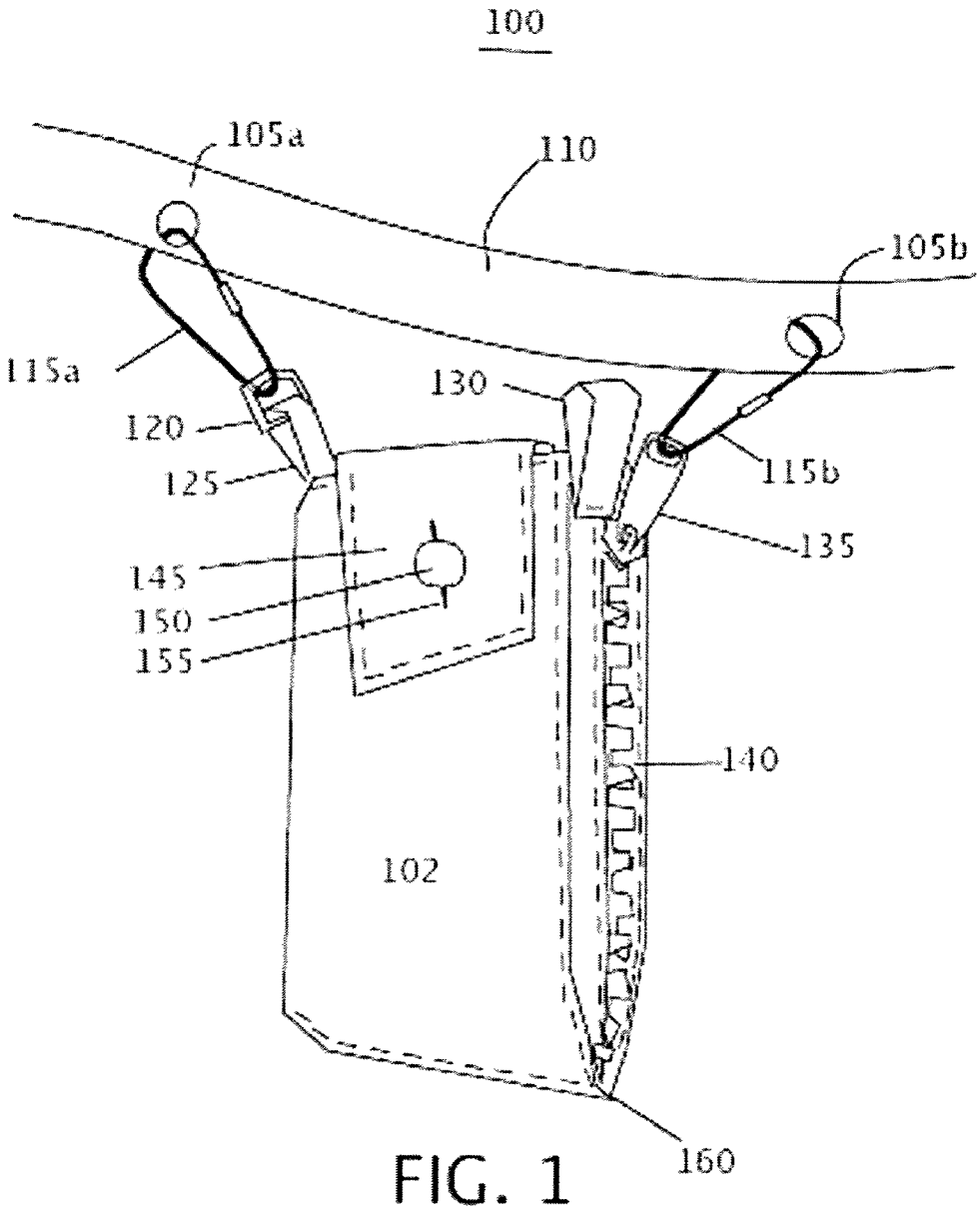
FIG. 1 is a perspective frontal view of an exemplary zip wallet in a closed position fastened to a belt in accordance with an embodiment oriented in a vertical position.

FIG. 1 is a perspective frontal view of an exemplary zip wallet apparatus 100 in accordance with an embodiment fastened on an individual's right side. A zip wallet apparatus 100 may similarly be constructed to be worn on an individual's left, front or the like. As shown, in this example, the apparatus 100 includes a belt, strap or the like 110 which may be worn generally about one's waist or similarly fastened to a backpack, bag or the like. The belt 110 may be constructed of leather, nylon, rubber, or the like constructed of varying durabilities as desired by the user and the particular use for the particular environmental conditions. In this example, the belt 110 contains two preformed holes 105*a*, 105*b* through which a connector such as a carabineer, metal, Velcro™, nylon, zip-tie, or the like 115*a*, 115*b* may be used to fasten to the belt 110. Such connectors 115*a*, 115*b* may be constructed to be temporary and of a removable nature or may be constructed to be attached to the belt 110 permanently. The connectors 115*a*, 115*b* are connected to a D-ring 120 or the like and a zipper slide 135 and zipper track 140, respectively to maintain the zip wallet 102 in a substantially vertical orientation when the zip wallet is in a closed position. The D-ring 120 or an equivalent known in the art may be constructed to freely rotate or may be of a rigid form. The D-ring 120 is affixed to an optional strap loop 125 which can be similarly constructed of leather, nylon, rubber or the like. The loop 125 is fastened to a top corner of the zip wallet 102. The zip wallet 102 may also directly fasten to the belt 110. An optional upper malleable flap 145 is fastened to the anterior of the zip wallet 102 by way of a slit 155 in the flap 145 and a button 150. The flap 145 can similarly be fastened via a clasp, or the like generally known by those of ordinary skill in the art. At least some portion of the zip wallet 102 may be constructed of an elastic material enabling greater leniency for rigid products contained therein and may further securely maintain the contents orientation and location within the zip wallet. To cause the zip wallet 102 to rotate to a substantially horizontal orientation, a user applies a force on optional loop 130 or the corresponding corner towards loop 125 where the fasteners 115*a* and 115*b* to thus create resistance causing the zipper slide 135 to separate the zipper track 140 enabling the individual to access the contents of the zip wallet 102. To cause the zip wallet 102 to rotate to a substantially vertical orientation, a user applies force in a downward direction at corner 160 to create resistance causing the zipper slide 135 to join the zipper track 140.

Figure 2:
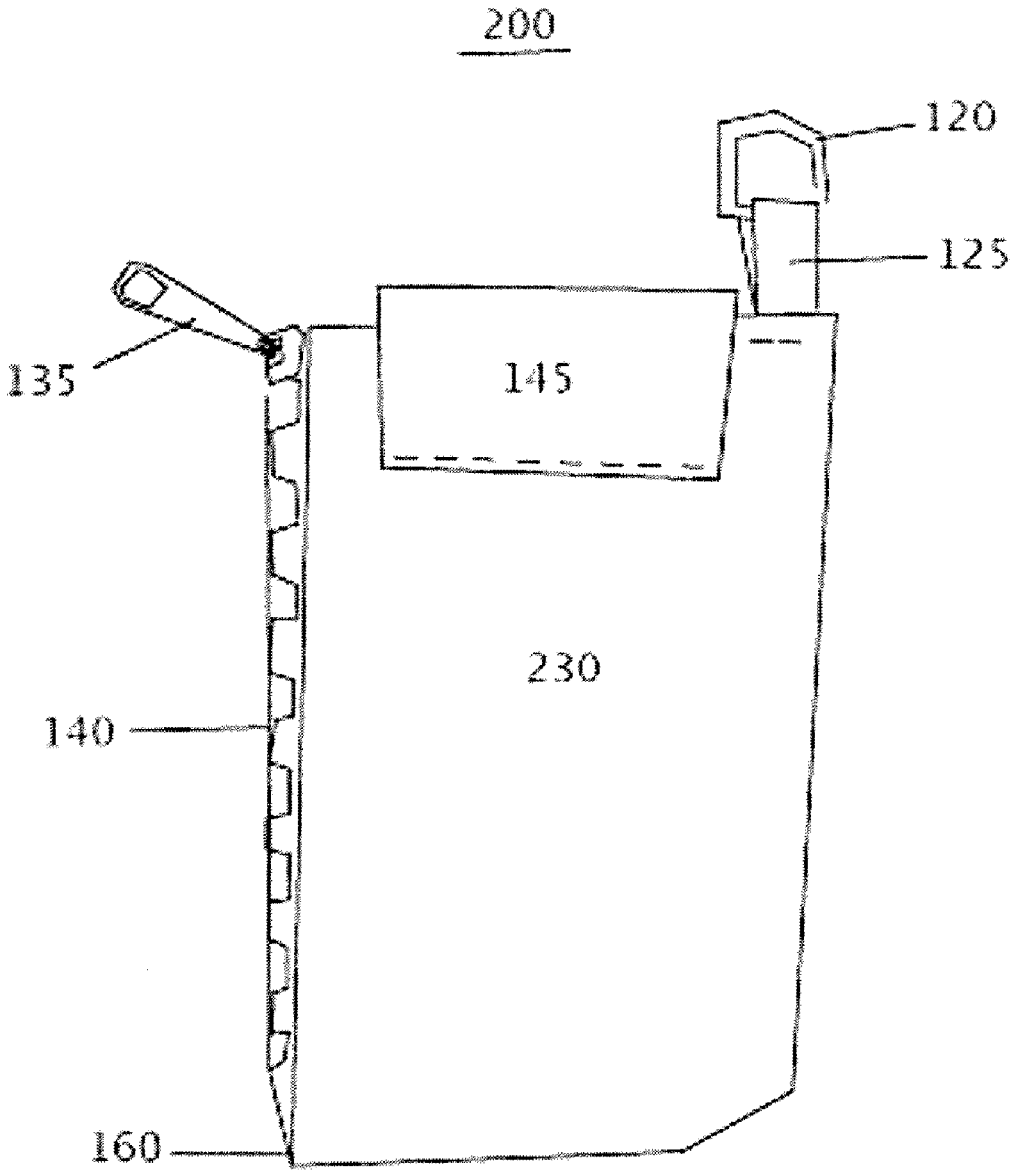
FIG. 2 is a perspective rear view of the zip wallet of FIG. 1.

FIG. 2 is a perspective rear view of the zip wallet apparatus 200 without the optional connectors 115*a*, 115*b* or belt 110. The zip wallet posterior 230 remains substantially directed towards the wearer while in both the horizontal and vertical orientations.

Figure 3:
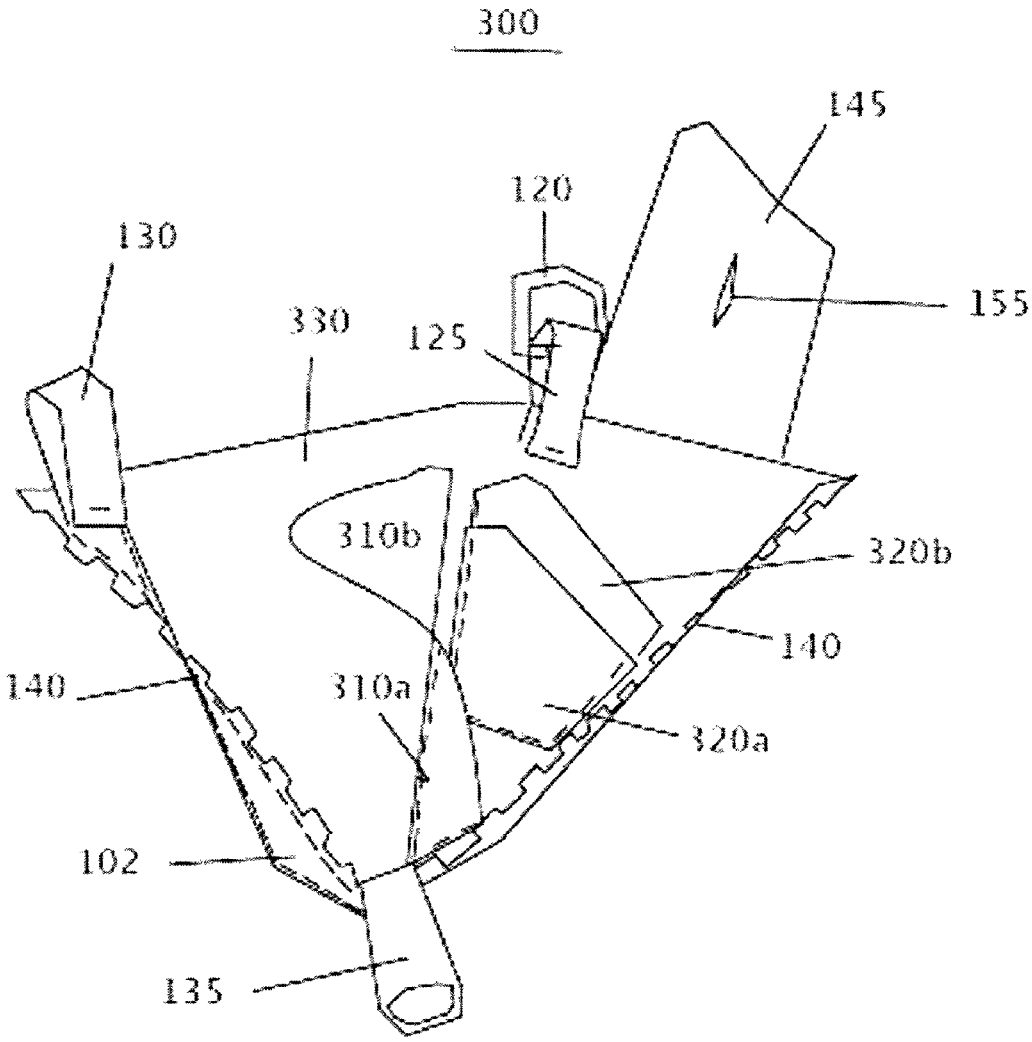
FIG. 3 is a sectional view of the interior of a zip wallet in accordance with an embodiment.

FIG. 3 is a sectional view of one configuration, for example, of the interior compartments of the zip wallet apparatus 300. In this embodiment, the interior of the zip wallet apparatus 330 is substantially divided into one or more sections, having, for example, two dividing sections 310*a*, 310*b*. The dividing flap 310*a*, 310*b* may be utilized to separate a cell phone, keys, legal tender notes, credit cards while maintaining an organizational scheme for quick access to any personal contents contained therein. Card sleeves 320*a*, 320*b* may further be implemented as an option to separate and organize credit, bank, public transportation or business cards.

Figure 4:
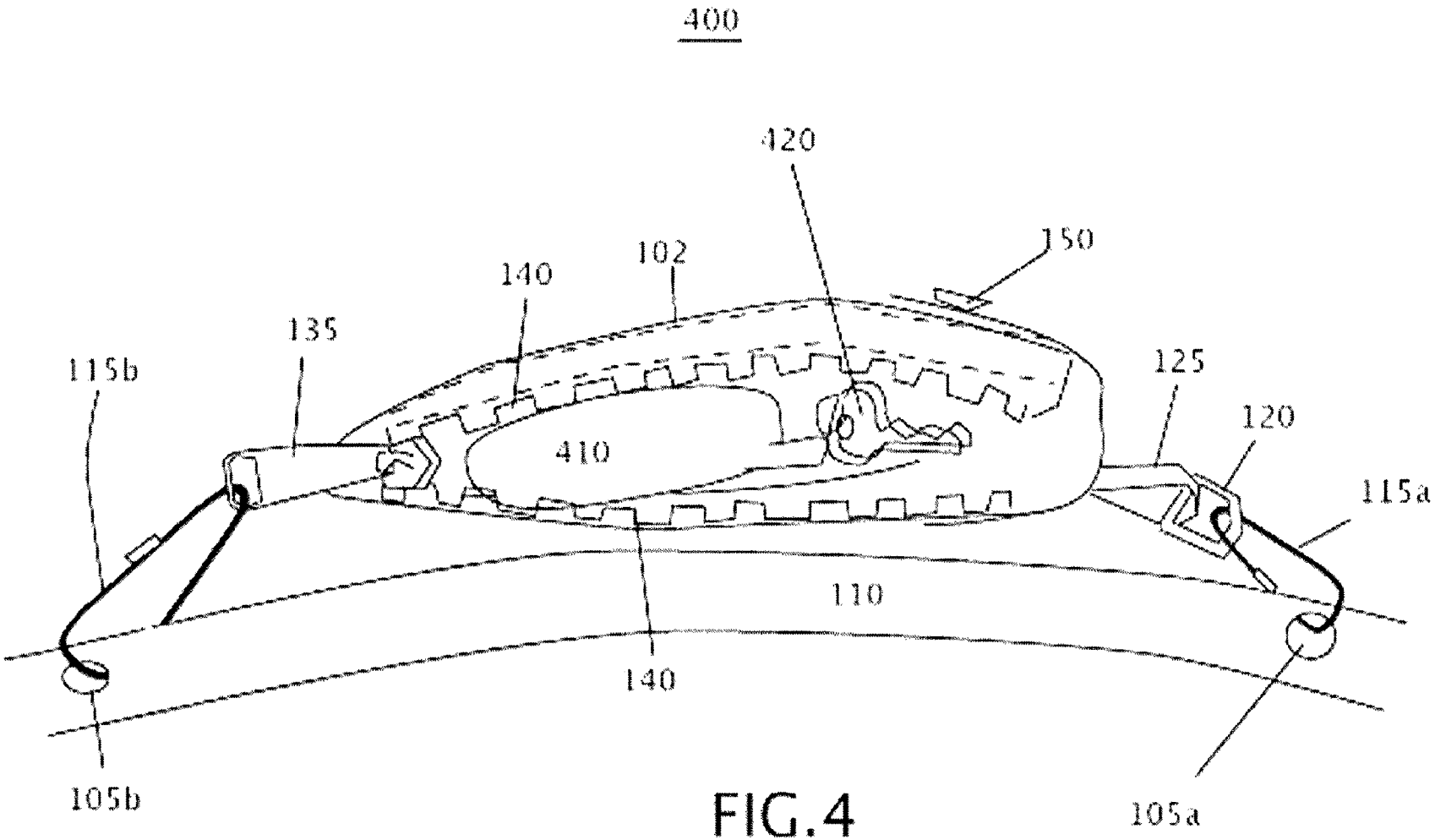
FIG. 4 is a top perspective view of the zip wallet fastened to a belt in accordance with an embodiment.

FIG. 4 is a top perspective of the zip wallet apparatus 400. In this embodiment, the D-ring 120 and the zipper slide 135 are fastened to the belt 110 via carabineers 115*a*, 115*b*, respectively. In this embodiment, when the zip wallet 102 is in a partially opened horizontal orientation it allows a user to access his necessary items such as a cell phone 410 and keys 420.

Figure 5:
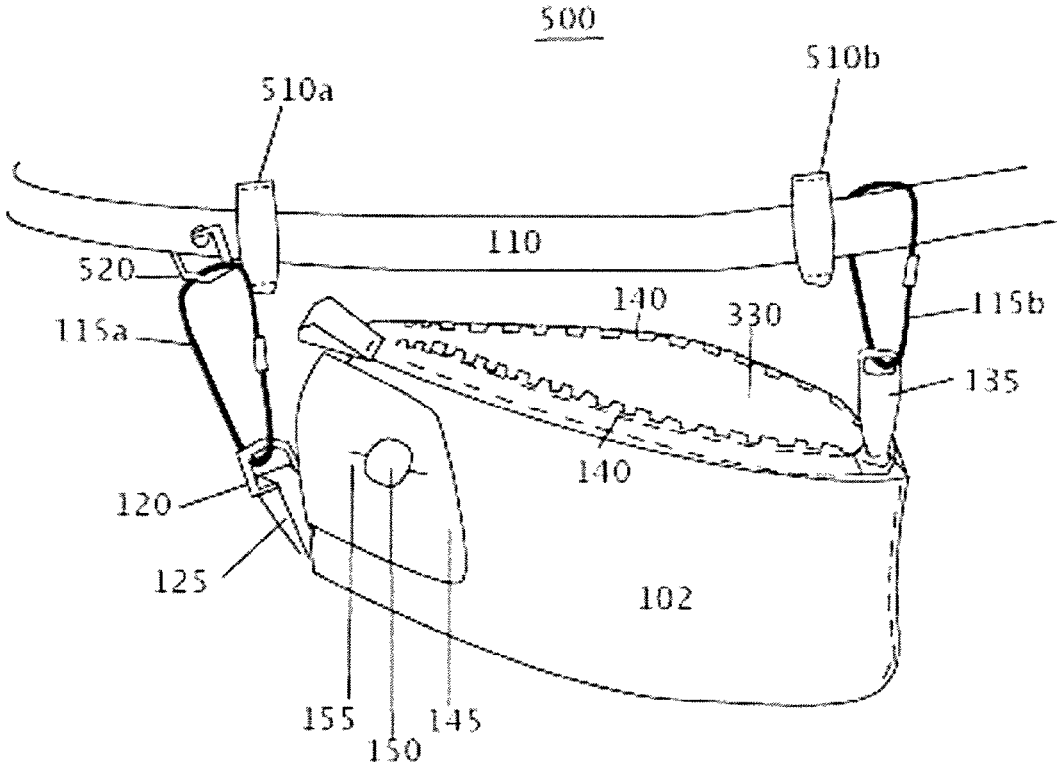
FIG. 5 is a perspective frontal view of the zip wallet in an open position fastened to a belt in accordance with an embodiment.

FIG. 5 is a perspective frontal view of the zip wallet apparatus 500 in a partially opened substantially horizontal orientation. In this example, the zip wallet 102 is fastened to the belt 110 via an intervening D-ring 520. Further, the belt 110 is fed through belt loops 510*a*, 510*b* to maintain the position of the zip wallet 102 in relation to a user's waist.

Figure 6:
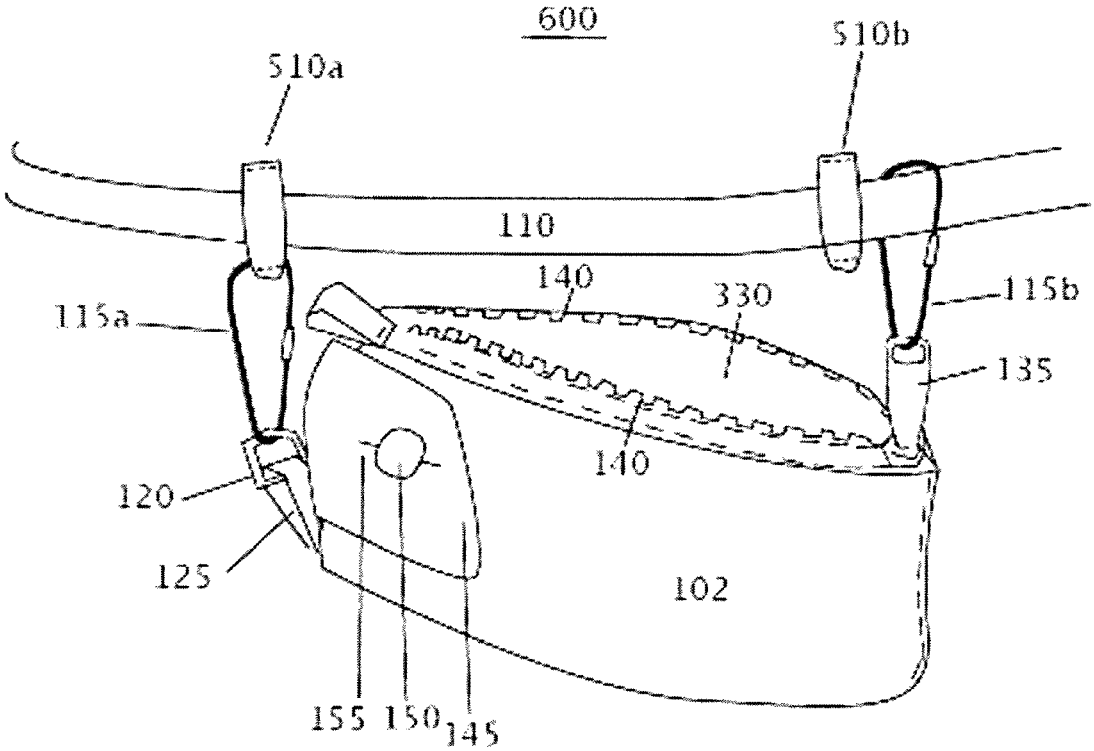
FIG. 6 is a perspective frontal view of the zip wallet in an open position fastened to a belt loop and a belt in accordance with another embodiment.

FIG. 6 is a perspective frontal view of the zip wallet apparatus 600 in a partially opened substantially horizontal orientation. In this example, an alternative method of fastening the zip wallet 102 is via the loop 125, D-ring 120, carabineer 115*a* and belt loop 510*a*.

Figure 7:
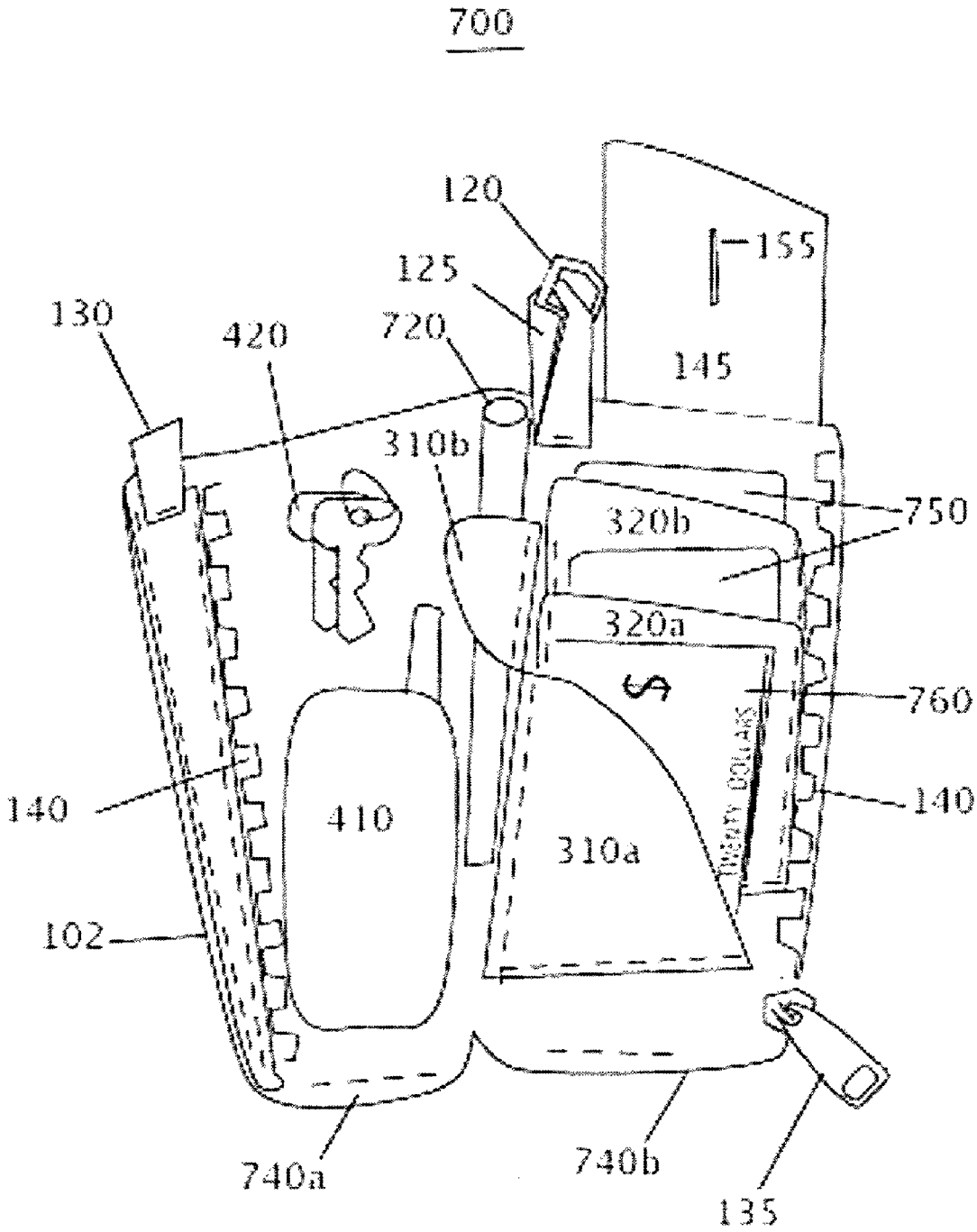
FIG. 7 is a sectional view of the zip wallet in an open position in accordance with an embodiment.

FIG. 7 is a sectional view of the zip wallet apparatus 700 in an open position containing exemplary personal items in accordance with one embodiment. The two bottom halves 740*a*, 740*b* of the zip wallet 102 are generally attached, but are shown separated to assist in viewing an organization embodiment of the interior regions 310*a*, 310*b*. Further, in this embodiment, substantially flat items are organized on the division closest to the user on the right half interior region 310*b* since this example is made for a right-handed user. Exemplary items include legal tender notes 760 and credit, bank, business and/or public transportation cards 750 which will not fall out, even if the wallet is left open. Legal tender 760, and the like, should be folded widthwise and tucked under the flap 310*a* to further secure it. A user may access the legal tender notes 760, cards 750, pens, cell phone 410, keys 420, etc., contained in the zip wallet using one hand even when secured by a seat belt or in a wheelchair. Such organizational division of substantially planar items and non-planar items allows the zip wallet 700 to lay flat against the user's side. Likewise, other configurations are possible depending on the user's location preference. Substantially non-planar items such as a cell phone 410, keys 420, a pen 720 or the like, are organized on the division furthest from the user. In this embodiment, this is on the left half interior region 310*a*.

Figure 8:
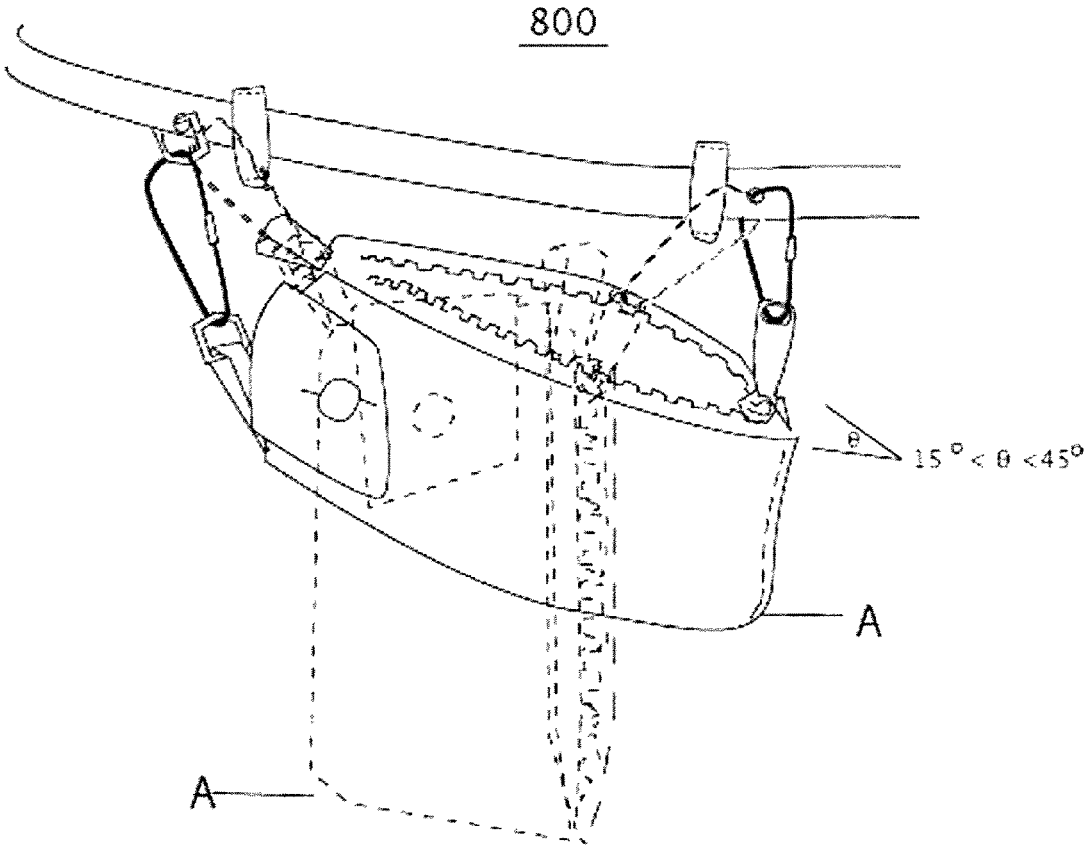
FIG. 8 is a perspective frontal view of the zip wallet with the zipper in a first position overlaid with the zipper in a second position with corresponding reference A.

FIG. 8 is a frontal perspective view of the zip wallet apparatus 800 in a substantially vertical orientation overlaid in a substantially horizontal orientation. Reference numeral A refers to the same corresponding corner of the zip wallet 102 in both the vertical and horizontal orientations. When the zip wallet 102 is in a substantially horizontal position, the degree (represented by θ) may vary substantially. Such variance is from 15°<θ<45° from vertical so as to prevent the contents from falling out.

While various embodiments of the present invention have been described above, it should be understood that they have been presented by way of example only, and not in limitation. Accordingly, it will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method of opening a wearable zip wallet with one hand, comprising:

providing a wallet, comprising: at least two surfaces defining an internal compartment; a zipper, being movable between a first position located at a first corner of the wallet and a second position located at a second corner of the wallet, connecting one of the at least two surfaces to another of the at least two surfaces; a first connector coupled to at least one of the two surfaces and fastened to a third corner of the wallet, the third corner being located across from the zipper when the zipper is in the first position and is diagonally opposite from the zipper from the zipper is in the second position, wherein the first connector is configured for attachment to a first article; a second connector having a first and second end, wherein the first end is coupled to the zipper and the second end is configured for attachment to a second article; wherein, when the zipper is in the first position, the wallet will be closed and will hang from the first and second articles, and when the zipper is in the second position, the wallet will be open and the zipper will be in a position rotated by an angular amount from its hanging position such that the zipper will be in a substantially horizontal position;

securing the first connector coupled to the wallet to the first article;

securing the second connector coupled to the wallet to the second article;

gripping the first corner above the zipper;

pulling the first corner in a longitudinal direction moving the zipper from a closed position to an open position; and rotating the wallet an angular amount such that the wallet with hang in a substantially horizontal position.

2. The method of claim 1 wherein one of the at least two surfaces is a substantially elastic surface.

3. The method of claim 1 wherein one of the at least two surfaces is a substantially rigid surface.

4. The method of claim 1, further comprising at least one card sleeve.

5. The method of claim 1, wherein the first connector and second connector are attached to a belt.

6. The method of claim 1, wherein the first connector and second connector are attached to a belt loop.

7. The method of claim 1, wherein the first article is selected from the group consisting of a belt, a belt loop, a strap, a backpack, and a bag.

8. The method of claim 1, wherein the second article is selected from the group consisting of a belt, a belt loop, a strap, a backpack, and a bag.

9. The method of claim 1, further comprising at least one internal surface which at least partially separates the internal compartment into at least two storage sections.

10. The method of claim 9, wherein the at least one internal surface separates the internal compartment into substantially equal storage halves.

11. The method of claim 9, further comprising at least a second internal surface which at least partially separates the internal compartment into at least three storage sections.

12. The method of claim 9 wherein the at least one internal surface separates the internal compartment into vertical storage sections.

13. A method of closing a wearable zip wallet with one hand, comprising:

providing a wallet, comprising: at least two surfaces defining an internal compartment; a zipper, being movable between a first position located at a first corner of the wallet and a second position located at a second corner of the wallet, connecting one of the at least two surfaces to another of the at least two surfaces; a first connector coupled to at least one of the two surfaces and fastened to a third corner of the wallet, the third corner being located across from the zipper when the zipper is in the first position and is diagonally opposite from the zipper from the zipper is in the second position, wherein the first connector is configured for attachment to a first article; a second connector having a first and second end, wherein the first end is coupled to the zipper and the second end is configured for attachment to a second article; wherein, when the zipper is in the first position, the wallet will be closed and will hang from the first and second articles, and when the zipper is in the second position, the wallet will be open and the zipper will be in a position rotated by an angular amount from its hanging position such that the zipper will be in a substantially horizontal position;

securing the first connector coupled to the wallet to the first article;

securing the second connector coupled to the wallet to the second article;

gripping the first corner below the zipper;

pulling the first corner in a longitudinal direction moving the zipper from an open position to a closed position; and rotating the wallet an angular amount such that the wallet with hang in a substantially vertical position.

14. The method of claim 13, wherein the first article is selected from the group consisting of a belt, a belt loop, a strap, a backpack, and a bag.

15. The method of claim 13, wherein the second article is selected from the group consisting of a belt, a belt loop, a strap, a backpack, and a bag.

* * * * *